United States Patent [19]

Bruckert et al.

[11] 3,939,638

[45] Feb. 24, 1976

[54] METHOD FOR AUTOMATICALLY STARTING AND STOPPING AN OPEN-END SPINNING MACHINE

[75] Inventors: Klaus Bruckert, Bremen; Herbert Hoffmann, Schwanewede; Gerhard Kutscher, Bremen; Rolf Neubert, Bremen; Rolf Wehling, Bremen, all of Germany

[73] Assignee: Fried. Krupp Gesellschaft mit beschrankter Haftung, Essen, Germany

[22] Filed: Mar. 20, 1974

[21] Appl. No.: 453,072

[30] Foreign Application Priority Data

Mar. 20, 1973 Germany ..... 2313788

[52] U.S. Cl. ..... 57/156; 57/34 R; 57/93; 57/58.89; 57/100

[51] Int. Cl.[2] ..... D01H 1/30; D01H 1/34

[58] Field of Search ..... 57/34 R, 58.89, 58.95, 57/78, 80, 81, 92, 93, 100, 156

[56] References Cited

UNITED STATES PATENTS

| | | | |
|---|---|---|---|
| 3,354,626 | 11/1967 | Cizek et al. | 57/58.89 X |
| 3,541,774 | 11/1970 | Sterba et al. | 57/78 |
| 3,704,579 | 12/1972 | Tooka et al. | 57/58.89 X |
| 3,760,576 | 9/1973 | Chatelier et al. | 57/34 R |
| 3,780,513 | 12/1973 | Watanabe et al. | 57/93 |
| 3,791,128 | 2/1974 | Landwehrkump et al. | 57/100 X |

*Primary Examiner*—Donald E. Watkins
*Attorney, Agent, or Firm*—Spencer & Kaye

[57] ABSTRACT

An open-end spinning machine system containing a plurality of spinning units, the components of each unit including a spinning turbine, a breakup roller, a feed roller, a yarn extraction device and yarn wiping apparatus, is controlled during stopping and subsequent restarting by an automatic control system which is operated by switching members in such a manner that, during stopping of the system, the turbine, feed roller, yarn extraction device and winding device of each unit are first permitted to decelerate in unison, in a free rundown manner while the rotating speeds remain within the range permitting yarn spinning to continue, and these components are positively braked only when their speeds approach the lower limit of such range, while during restarting of the system, the yarn extraction device and the yarn winding device of each unit are caused to rotate through a selected distance in the direction opposite to their normal operating direction for feeding a fixed length of yarn back into the associated spinning turbine, whereafter the end of the length of yarn fed back into the turbine becomes combined with the yarn which starts to form in the turbine when the spinning operation of the turbine is reestablished.

12 Claims, 3 Drawing Figures

METHOD FOR AUTOMATICALLY STARTING AND STOPPING AN OPEN-END SPINNING MACHINE

BACKGROUND OF THE INVENTION

The present invention relates to a method for automatically starting and stopping an open-end spinning machine of the type composed of a plurality of spinning units each including a spinning turbine, a breakup roller, a yarn extraction device and a winding apparatus.

The invention employs the basic concept that the yarn ends are to remain in the spinning turbines when the spinning machine is shut down and these ends are to be fed back into the spinning turbines upon restarting of the machine, this being achieved by a limited reverse operation of the yarn extraction devices and winding apparatuses.

When fiber rovings are spun into fine yarns, by a technique which does not employ the rings commonly associated with ring spinning, a strip of fibers consisting of staple fibers is fed via a feed roller to a rotating breakup roller and is there broken up into individual fibers. The individual fibers already broken out of the bundles of fibers are conducted by the subatmospheric pressure produced by the spinning turbine and by the flow conditions existing in the spinning chamber to the intake area of the spinning turbine, where they are conducted along the conical inlet portion of the spinning turbine into the fiber collection trough. From this point on, the fibers are then reinforced by twisting, are fed through the center of the spinning turbine as yarn, and are guided, by means of a pair of extraction cylinders, to winding apparatus.

During the usual shut-down of the spinning machine, the feed rollers, the spinning turbines, the breakup rollers, the extraction cylinders and the winding apparatuses are stopped. This results in a relatively rapid loss of the subatmospheric pressure required for the spinning process and thus causes all of the threads to break. During the usual restarting of the machine, it is then necessary to manually remove all broken threads. In this case each yarn end must be manually inserted into the yarn extraction tube and from there the subatmospheric pressure produced in the rotating spinning turbine sucks the yarn back into the fiber collection trough. There the individual fibers which were fed in the meantime to the input side of the spinning turbine by the feed roller and the breakup roller are then spun to the reintroduced yarn end, and the yarn which then forms is again continuously fed by the pair of extraction cylinders to the winding apparatus.

The reestablishment of spinning, by hand, described above insofar as concerns its significant steps is time-consuming, considerably reduces the output of the spinning machine and greatly increases personnel costs.

SUMMARY OF THE INVENTION

It is an object of the present invention to overcome these drawbacks.

A more specific object of the present invention is to provide a process which permits starting and stopping of the above-mentioned type of spinning machine without, or almost without, breakage of threads.

This is accomplished, according to the present invention by causing, during stopping of the spinning machine, an automatic switch-off control to effect a simultaneous reduction in the rate of rotation of the spinning turbines, the feed rollers, the yarn extraction devices, the winding apparatuses, and possibly also the breakup rollers, by means of a switching member, the rotating speed being so reduced while remaining within limits which correspond to prevalent spinning conditions, and when the lower limit of this range has been reached, positively and quickly braking these units until they come to a standstill. The objects according to the invention are further achieved, when the spinning machine is started, by causing an automatic starting control, actuatable by means of a further switching member, to control a limited movement of the yarn extraction devices and of the winding devices through a fixed distance in the reverse direction, so that, independent of the selected rate of rotation of the spinning machine, always the same length of yarn is fed back into the spinning turbines.

In an exemplary embodiment of the invention, when the spinning machine is started, the breakup rollers initially run up individually to their rated speed. After completion of the transient starting period of the breakup rollers, the spinning turbines enter a transient starting period until they reach a certain speed, the so-called start-of-spinning speed which can be set in dependence on the yarn count, or weight per unit length. Once the spinning turbines and the breakup rollers have reached this speed, the extraction cylinder and the winding apparatus are started up by a time relay in the direction opposite to the normal operating direction so that they feed a certain length of previously spun yarn back into the fiber collection trough of the spinning turbines and this feeding is aided by the subatmospheric pressure produced in the spinning turbines. In dependence on the occurrence of yarn feedback into the spinning turbines, the feed rollers at the input side of the turbines begin, after a time delay, to feed bands of staple fibers. Now the so-called spinning start can take place.

Once this is accomplished, the yarn extraction cylinder and the winding device begin to rotate in the operating direction. The yarn is then continuously drawn off and wound up in a criss-cross pattern.

Upon completion of the start-of-spinning phase, the spinning machine changes to its rated speed, also known as the spinning speed, under the control of a time relay. If during starting of the spinning machine a thread breaks at any of the spinning units, the thread monitor will at once stop the feeding of rovings to this particular spinning unit. The unit in question must then be started up manually.

When the spinning machine is shut down, first the main drive motor is disconnected. Except for the breakup roller, the rate of rotation of the spinning machine continuously decreases from the spinning speed until reaching the minimum speed conditions at which open-end spinning can still occur. Only then will the brake for the main drive become effective in order to stop the spinning machine so quickly that the yarn ends still remaining in the spinning turbines are available for a renewed start-of-spinning process. Once this is accomplished, a time relay stops the drive motor for the breakup rollers. The breakup rollers then slow down until they stop.

The starting of the spinning machine, i.e. the start-of-spinning in all spinning chambers provided in the machine, presupposes prior shutting off or setting of individual members of the spinning machine in an accurate sequence and in certain time intervals, the sequence and the time intervals being given by the parameters of the yarn to be spun and by the type of fibers to be used, i.e. by its denier and staple length.

In a modification of the above-described starting characteristics according to the present invention, it is also possible to accomplish a start-of-spinning phase almost without a broken thread by feeding the fibers already broken out of the fiber band into the spinning turbine, at its inlet end, before the yarn feedback into the spinning turbine is completed, i.e. before the temporary reversing of the pair of yarn extraction cylinders has been completed. According to this feature of the present invention, the starting of the feed roller can thus take place independently of the reversing of the yarn extraction cylinder.

An advantage of this type of drive system is that the fed-in yarn end, i.e. the start of the spun yarn, is not subjected to an excess increase in speed by the time-offset, beginning with the end of the reversal up to the fiber intake, but rather that the fibers are already fed in when the starting thread is still being fed back so that a time-offset becomes unnecessary.

A further advantage for the independent driving of the feed roller by the reversing gear is that the entire open-end spinning machine can be driven by one drive motor.

DESCRIPTION OF THE PREFERRED EMBODIMENTS

Figure 1:
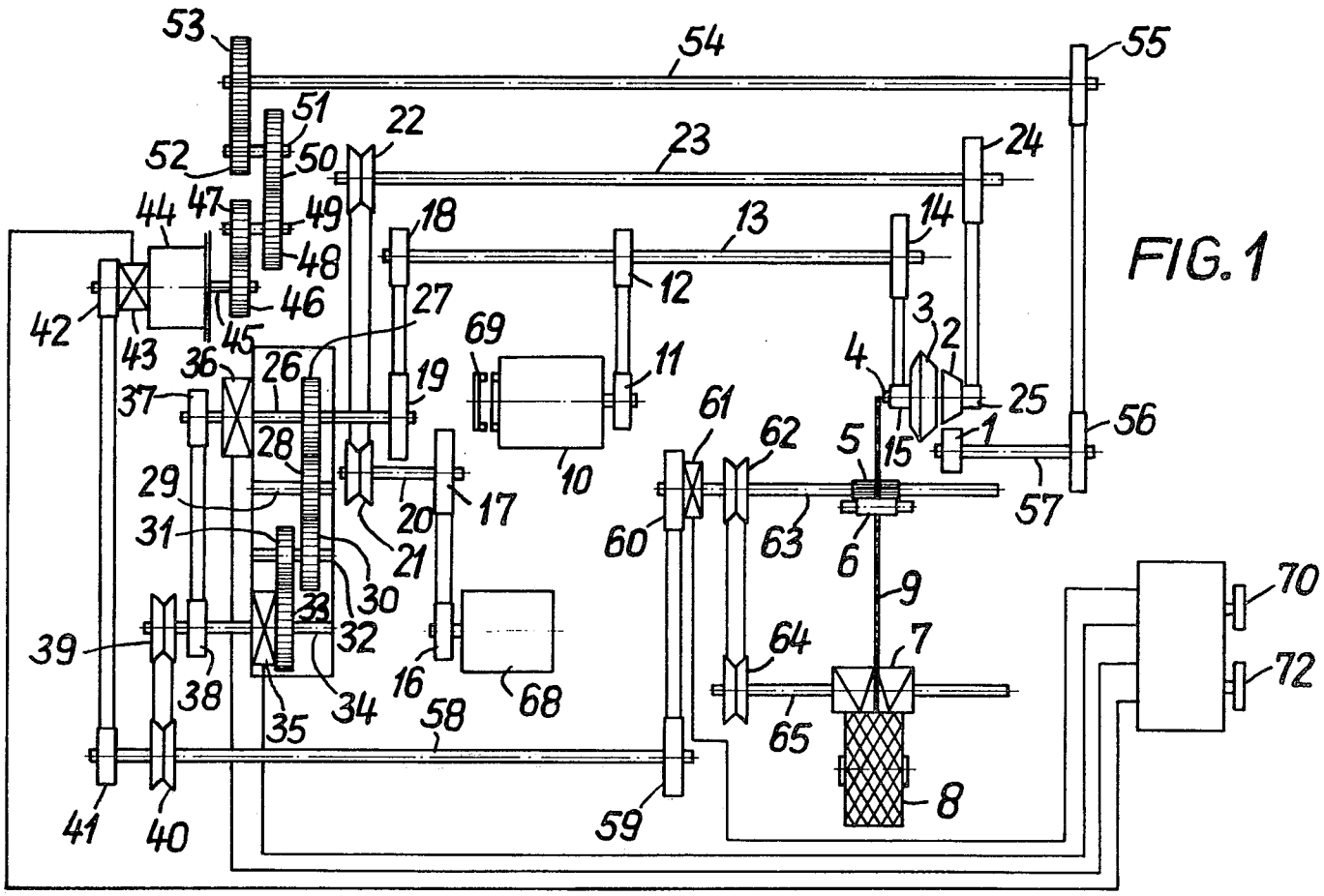
FIG. 1 is a schematic representation of the operating parts of an open-end spinning machine capable of operating according to the present invention.

Since the plurality of spinning units of the open-end spinning machine coincide in their design, only one such spinning unit is shown in FIG. 1 for reasons of simplicity. Each spinning unit includes a feed roller 1 fastened to a shaft 57, which is rotatably mounted on a machine base on bearings (not shown), a breakup roller 2, and the spinning turbine 3 which is of conventional design and which is rotatably mounted on the machine base. The spinning turbine 3 is provided with air channels which during rotation support an air flow that produces the subatmospheric pressure required for the spinning process so that the fibers already released from the fed-in fiber strip, or band, can travel through the fiber collection area into the fiber collection trough of the spinning turbine 3 from where they are extracted as yarn 9 through the yarn extraction tube 4, which is stationary in the center of the spinning turbine 3. The extraction force is provided by a pair of extraction rollers 5 and 6. Yarn extraction can also be effected through the center of the breakup roller.

The pair of extraction rollers 5 and 6 includes a fluted roller 5 keyed on a shaft 63 which itself is rotatably mounted on the machine base in bearings (not shown) and a rotatable pressure roller 6 spring-biassed against roller 5. From here the yarn 9 moves to a slitted drum 7 keyed on a shaft 65, which itself is fastened to the machine base in bearings (not shown). Shaft 65 is driven by shaft 63 by means of a drive, composed of a V-belt and pulleys 62 and 64, of the type whose transmission ratio can be varied continuously over a selected range. The slitted drum 7 in turn drives a rotatably mounted yarn spool 8 by means of friction and the yarn 9 is wound thereon in a criss-cross pattern.

When the operator actuates a switching member 72, the drive motor 68 for the breakup roller 2 is started. The drive motor 68 drives an intermediate shaft 20 via belt pulleys 16 and 17. Intermediate shaft 20 drives a shaft 23 via a V-belt and pulleys 21 and 22 which also form a drive whose transmission ratio can be continuously varied over a selected range. A pulley 24 disposed on shaft 23 then drives the breakup roller 2 via whorl 25. The running up of the breakup roller 2 to its rated speed during an early phase in the starting of the machine has the advantage that optimum conditions for combing out the rovings into individual fibers are present at the onset of the actual start-of-spinning phase.

Upon completion of the transient starting period of the breakup roller 2, when it has reached its rated speed, the main drive motor 10 is started under the control of a time relay. This motor then drives the main drive shaft 13 via belt pulleys 11 and 12 and the main drive shaft 13 drives the whorl 15 of the spinning turbine 3 via pulley 14 and a drive belt.

The system includes four electromagnetic couplings 35, 36, 43 and 61 which are open, i.e. are not providing force-transmitting connections during this phase of the start-up of the spinning machine.

The drive connected via shaft 13, pulley 14 and spinning turbine drive whorl 15, increases the rotation of spinning turbine 3 to a certain rate, which is the start-of-spinning speed.

Once the breakup roller 2 has reached its rated speed and the spinning turbine 3 has reached its start-of-spinning speed, the time relay control places the couplings 35, 36, 43 and 61 in the following states:

Coupling 36 is open,
coupling 35 is closed,
coupling 61 is closed and
coupling 43 is open.

That means that, beginning from the main drive shaft 13, the drive is effected via pulleys 18 and 19, and intermediate shafts 26, 29, 32 and 34 by means of gears 27, 28, 30, 41 and 33.

Shaft 34 is operatively coupled to an intermediate shaft 58 via closed coupling 35 and a V-belt and pulleys 39 and 40 constituting a drive whose transmission ratio can be continuously varied over a selected range. Shaft 58 then drives, via pulleys 59 and 60 connected by a belt and the closed coupling 61, the fluted roller 5 which is fastened to shaft 63 and, via control pulleys 62 and 64, the slitted drum 7 fastened on shaft 65.

Thus, under the control of a time relay, shafts 63 and 65 revolve in a direction opposite to their normal operating direction so that they feed a defined length of yarn from winding spool 8 back into the spinning turbine 3. If the extent of reverse movement of the fluted roller were here controlled by a time relay, then different lengths of yarn would be fed back into the spinning turbine for different turbine speeds. Since a certain length of yarn is required for the start-of-spinning phase, which length is dependent on the diameter of the spinning turbine, the fluted cylinder 5 must be controlled so that during its reverse rotation it rotates through a fixed angular distance, i.e. a point on its periphery traverses a path of predetermined length. The constant-length yarn feedback is feasible, for instance, by variation of the reverse time constants in dependence on the spinning speed or start-of-spinning speed or by direct control of the reverse motion path or reverse motion angle through an angular distance transmitter attached to the shaft 63.

At this time, again controlled by a time relay, the so-called start-of-spinning phase begins, which is effected by placing the electromagnetic couplings in the following states:

Coupling 36 is closed,
coupling 35 is open,
coupling 61 is open and
coupling 43 is closed.

Starting from shaft 26, which is constantly driven by shaft 13, shaft 45 is driven via closed coupling 36, pulleys 37, 38, 39 and 40, shaft 58, pulleys 41 and 42 and a reduction gear 44. This shaft 45 drives shaft 54, via intermediate shafts 49 and 51, by means of gears 46, 47, 48, 50, 52 and 53. Via pulleys 55 and 56, shaft 54 drives shaft 57 to which the feed roller 1 is fastened, i.e. the feeding of fiber rovings to the breakup roller 2 begins.

Shortly after the beginning of the feeding of the fiber rovings and the subsequent separation of the rovings into individual fibers, the direction of rotation of fluted roller 5 with the pressure roller 6 and the slitted drum 7 with the yarn spool 8 is reversed so that they now continuously extract the yarn from the spinning turbine 3. In order to reverse the direction of rotation, the electromagnetic couplings must be placed in the following states:

Coupling 36 is closed,
coupling 35 is open,
coupling 61 is closed and
coupling 43 is also closed.

Shaft 26 thus continues to rotate shaft 58 via closed coupling 36, pulleys 37 and 38, and the control discs constituting pulleys 39 and 40. The intermediate shaft 58 then drives shaft 63 via pulleys 59 and 60 and the closed electromagnetic coupling 61. Shaft 63 then directly drives, as described above, the yarn extraction devices 5, 6 in the forward direction and indirectly, via the variable drive formed by the V-belt and pulleys 62 and 64, the winding apparatus 7, 8, also in the forward direction.

As soon as the above-described start-of-spinning phase is completed, the spinning machine automatically changes, under the control of a time relay, to the previously selected rated spinning speed.

The switching off of the open-end spinning machine is effected by actuation of the switching member 70. This causes the main drive motor 10 to be switched off. All parts driven by main drive motor 10 then decelerate from their rated speed to a speed at which the spinning conditions required for open-end spinning are still just met in the spinning turbine. Thereafter a brake 69 is applied to cause the spinning machine to stop quickly.

Since the time of actuation of the brake has a decisive effect on the proper restarting of the spinning operation, this time must be selected so that when the spinning machine is stopped the yarn end which was just previously formed remains in the yarn extraction tube 4. In order to be able to satisfy this requirement, the brake 69 must always engage the shaft of motor 10 in a force-transmitting manner when the motor is running at a certain speed whose value depends on the parameters of the material to be spun, this being effected by speed monitors. With a certain time delay after engagement by brake 69, a time relay controls the switching off of the drive for the breakup roller 2, after the spinning machine has stopped.

The delayed stopping of the breakup roller 2 need not necessarily be provided but it has the advantage that the fiber rovings fed in during the slowdown of the machine are still continuously separated and thus assure perfect spinning until brake 69 responds.

The electromagnetic couplings become automatically reset so that renewed starting of the spinning machines becomes possible.

Figure 2:
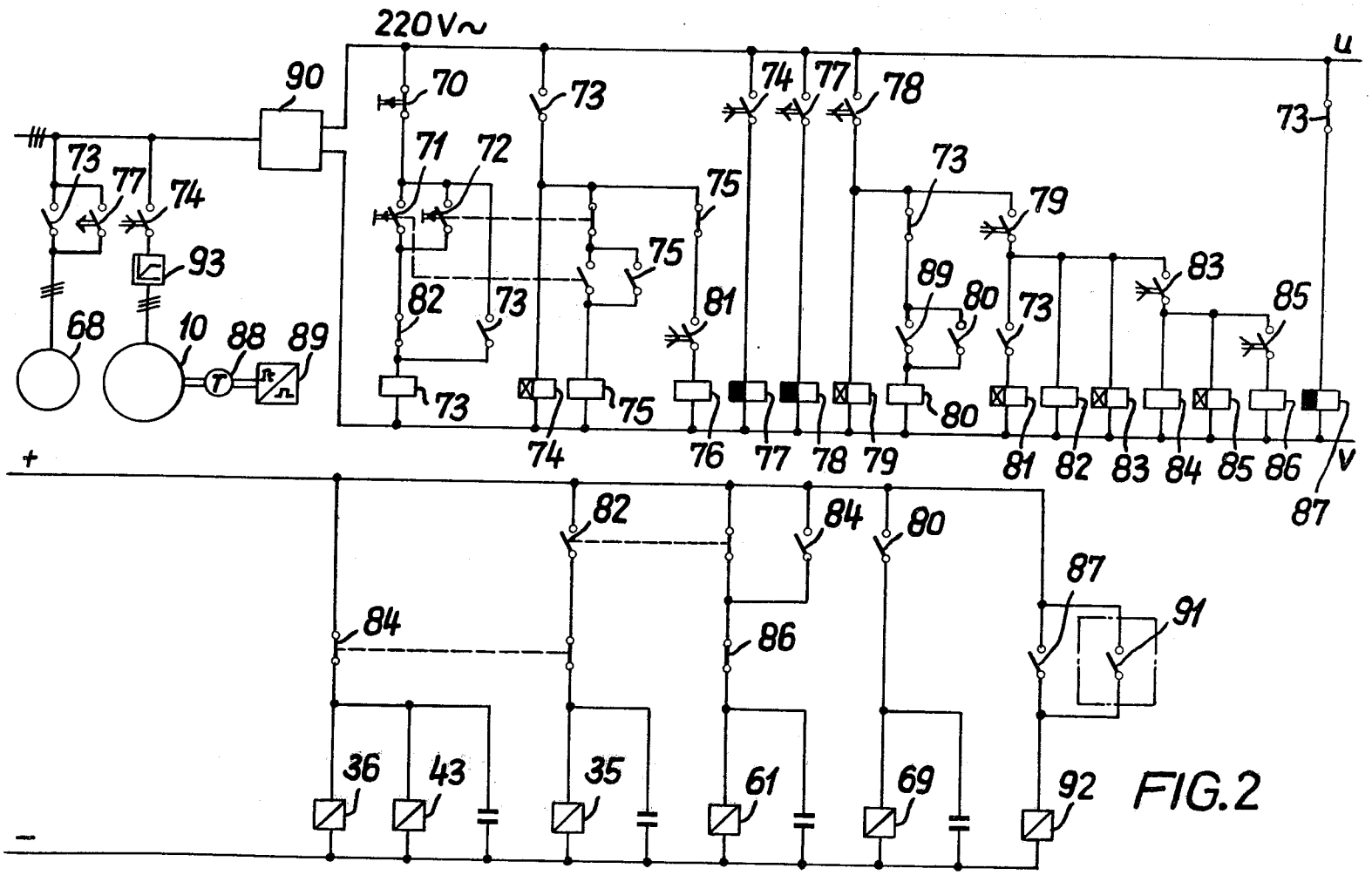
FIG. 2 is an electrical circuit diagram of the circuitry of the control device for the spinning machine of FIG. 1.

As can be seen in FIG. 2, which presents a schematic representation of one embodiment of the circuitry of the control device, the start-of-spinning phase is initiated by closing normally-open switching member 71, the rated-speed spinning phase is initiated by closing normally-open switching member 72 and the switch-off phase is initiated by opening normally-closed switching member 70, all of which are shown in their normal positions.

All air-core relays, switching relays and couplings shown symbolically in FIG. 2 are fed by a transformer 90. The movable contacts of the relays bear the same reference numeral as their associated coil and are all shown in their deactuated, or normal position.

The couplings 36, 43 and 61 are actuated when no current is applied thereto while the brake 69 and couplings 35 and 92 are actuated by the application of operating current.

Relays 74, 79, 81, 83 and 85 are of the type which become actuated a fixed time after application of operating power to their coils and which become deactuated substantially immediately after removal of operating power from their coils. The coils of relays of this type are identified by a small *x*. Conversely, relays 77, 78 and 87 are of the type which become actuated substantially immediately upon application of operating power to their coils and become deactuated a fixed time afer removal of operating power. The coils of these relays are identified by a small solid black area. The remaining relays, 73, 75, 76, 80, 82, 84 and 86, are substantially immediately actuated upon application of power to, and deactuated upon removal of power from, their coils. Switches 70–72 are of the momentarily actuated type.

Start-of-Spinning Phase

The air-core relay 73 is actuated by closing of switching member 71 and the drive motor 68 for the breakup roller is switched on. At a fixed time after the starting of motor 10, and as a result of actuation of time delay relay 74, the speed controlled main drive motor 10 begins to operate to drive the turbine and later the feed roller, the feed cylinder and the winding apparatus. The transient starting period of the main drive motor 10 from zero speed to the start-of-spinning speed or the spinning speed, respectively, can be continuously varied within wide limits by a starting generator 93.

The actuated relay 73 also disconnects relay 87 from the power source. Relay 87 is of the delayed-release type so that its movable contact opens after a set time interval. Up to the end of this interval, couplings 92 which are provided in the longitudinal portion of each spinning location become force-transmitting and remain in this operating position if the micro-switches 91 have in the meantime been depressed by an increasing yarn tension.

If the threads have broken, however, and the microswitches 91 have thus not been depressed, couplings 92 will open after time relay 87 has dropped out, and interrupt the feeding of rovings to the turbines. The microswitch 91 is located between outlet 4 of the spinning turbine 3 and the yarn extraction devices 5 and 6 in the area of the yarn extraction. It actuates the coupling 92 which causes the feed roller 1 to disconnect from the drive shaft 57. A more detailed description of these components is given, for instance, in the U.S. Pat. No. 3,210,923, FIG. 7 (microswitch 49,50; coupling 52,53).

Upon closing of the start-of-spinning switch 71 the air-core relay 75 is also actuated so that the air-core relay 76, which is responsible for the switching of the rated speed value from the start-of-spinning speed to the spinning speed, is prevented from being actuated.

Upon actuation of the time delay relay 74, the time delayed drop-out relay 77 becomes actuated and this immediately switches on the time delayed drop-out relay 78. This in turn supplies operating power to time delayed turn-on relay 79. The delayed turn-on time of relay 79 is longer than the transient starting period for the main drive motor 10 and actuation of relay 79 connects the delayed turn-on relays 81 and 83 and the air-core relay 82 to the power supply. Actuation of air-core relay 82 causes the operating current-actuated coupling 35 of the reversal gear to be closed, i.e. a voltage is applied thereacross to place it in its force transmitting state, and also closes coupling 61 for the yarn extraction devices, by disconnecting that coupling from the power supply.

The reversing gear and the yarn extraction rollers are thus temporarily connected to operate in the reverse direction. After the time-delayed actuation of relay 81, the air-core relay 76 still cannot be actuated, however, since the auxiliary normally-closed contact of relay 75, which is connected in series with the switching contact of relay 81, is opened by the actuation of the start-of-spinning switch 71.

After expiration of the time delay associated with relay 83 the air-core relay 84 and, subsequently the delayed turn-on relay 85 are actuated. Actuation of relay 84 disconnects couplings 36 and 43 of the reversing gear and of the feed roller from the power supply, so that these couplings thus close to establish force-transmitting connections, and also disconnects coupling 35 of the reversing gear from the power supply so that this coupling opens. The actuation of relay 84 also applies current to coupling 61 of the feed cylinder to open this coupling.

Thus, at the moment of actuation of relays 83 and 84, the reversing gear is switched from the reverse rotation state to the forward rotation state, and the extraction devices stop but the fiber input system remains the same.

At the expiration of the delayed response time of relay 85, the relay 86 is actuated to terminate the flow of current to coupling 61, closing that coupling so that the extraction devices 5, 6, 7 and 8 start up in the forward operating direction.

With this switching process, the so-called start-of-spinning phase of the open-end spinning machine is completed.

Finally, it should be noted that, during operation, a depression of the start-of-spinning switch 71 or spinning switch 72, respectively, can be used selectively as desired to cause operation at the start-of-spinning speed or at the spinning speed. This is effected by switching the rated speed value by means of relay 76 which is either deactuated (start-of-spinning) by the relay 75 or actuated (spinning). A prerequisite for the selective switching of the speed is that the delayed turn-on time of relay 81 must have expired. This also applies for the spinning phase. The contacts of relay 76 are operationally connected to the run-up speed governor 93 of the main drive motor 10.

Spinning phase

The spinning phase is actually identical to the start-of-spinning phase, with the exception that upon switching on the spinning machine the spinning key 72 is depressed. This has the result that air-break relay 75 cannot be actuated and thus the rated speed value will automatically be switched from the start-of-spinning speed to the spinning speed by actuation of air-core relay 76 when the turn-on time delay of relay 81 has expired and relay 81 is thus actuated.

Shut down phase

Depressing the switching member 70 removes operating current from air-core relay 73 and time relay 74, and thus from the main drive motor 10. The time delayed turn-off relay 87 becomes actuated immediately upon deactuation of relay 73 and bridges the microswitches 91 so that the couplings 92 remain closed even when the thread tension decreases and thus maintains the feeding of rovings to the turbines.

Upon deactuation of relay 73, the rated speed value is switched at once to the start-of-spinning level since air-core relays 75 and 76 have also been disconnected from their current supply. The time delayed turn-off relay 77 is also disconnected from the current source and switches off the drive motor 68 for the breakup roller after expiration of its turn-off time delay. Upon deactuation of relay 77, the time delayed turn-off relay 78 is also disconnected from the current source.

If the rate of rotation of the main drive motor 10 has dropped to the value set by the speed-dependent switch 89, this switch responds and switches on the motor brake 69 by actuating air-core relay 80. A tachometer 88 which is operatively connected to the drive motor 10 supplies switch 89 with a speed-proportional voltage. The instant of switching must be so selected that the yarn end still remains in the yarn extraction tube in the spinning chamber and is not pulled out by the extraction rollers.

Once relay 78 has also been deactuated, couplings 36, 43 and 61 are returned to their starting states by deactuation of relays 79, and 82–86, whereas coupling 35 had already returned to its starting state during the starting phase. Only now can the spinning machine be switched on again since a movable contact of relay 82 prevents renewed actuation of relay 73 during the shut-down phase.

Figure 3:
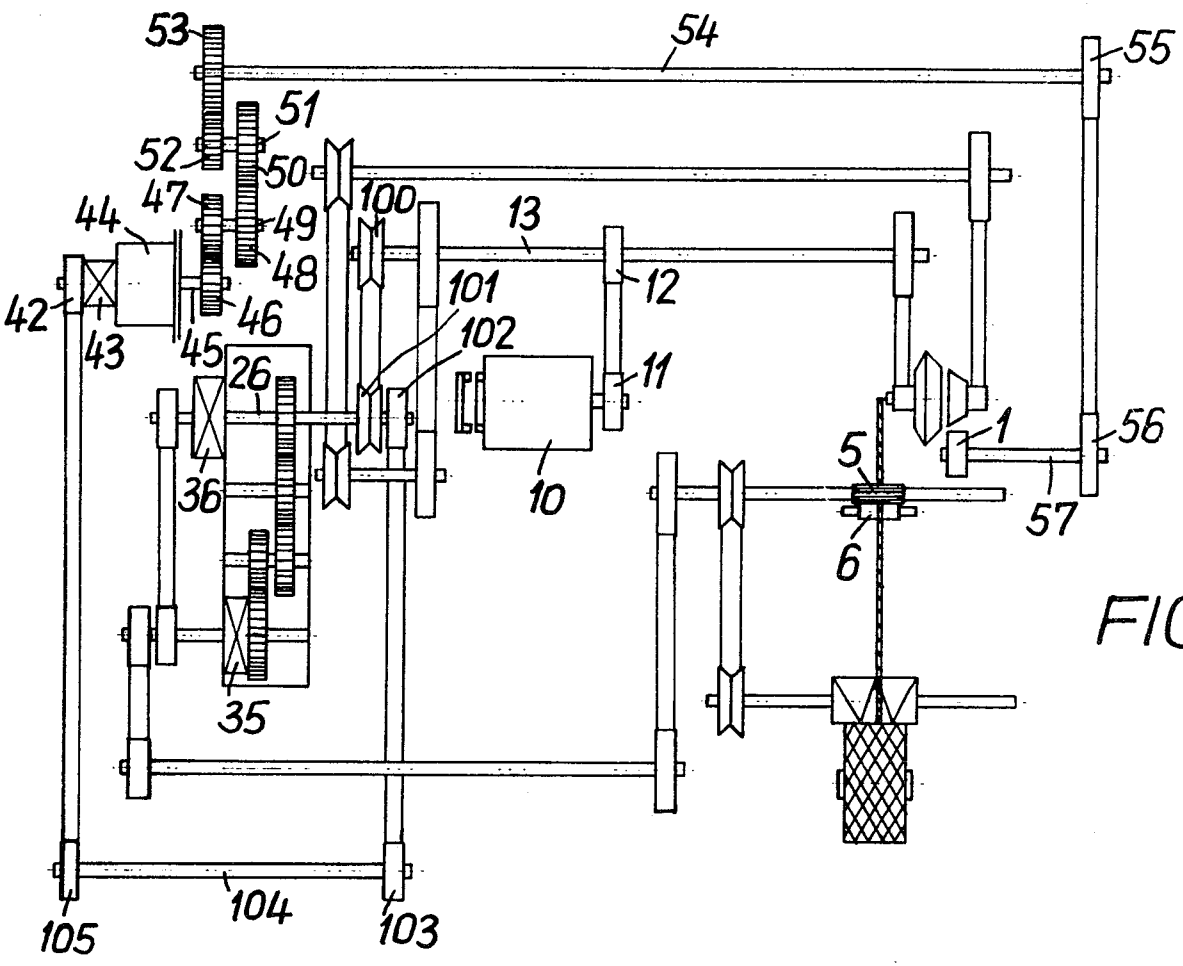
FIG. 3 is a schematic representation of the operating parts of another open-end spinning machine which can be operated according to another embodiment of the present invention, the entire open-end spinning machine being driven by but one drive motor.

FIG. 3 illustrates a system which differs from that shown in FIG. 1 in that the starting phase of the feed roller can take place independently of the reverse movement of the yarn extraction rollers so that it is possible to begin feeding the rovings even before the reverse movement of the yarn extraction rollers is completed. In this case the feed roller is driven in the following manner as shown in FIG. 3:

Drive motor 10 drives, via pulleys 11 and 12, the turbine drive shaft 13. Shaft 13 drives shaft 26 via control pulleys 100 and 101 providing a variable transmission ratio. Shaft 26 drives intermediate shaft 104 via pulleys 102 and 103. Shaft 104 drives step-down gear 44, via pulleys 105 and 42 and closed coupling 43. The feed roller 1 is then driven via intermediate shafts 45, 49, 51, 54 and 57 by means of gears 46, 47, 48, 50, 52 and 53 and pulleys 55 and 56.

Couplings 35 and 36 are open at this time, or coupling 35 is closed to permit reverse movement of the pair of yarn extraction rollers 5 and 6.

The starting phase of the feed roller is controlled by a timing relay.

As can be seen at once in FIG. 3, the breakup roller is also driven by drive motor 10, unlike the drive system according to FIG. 1, so that the entire open-end spinning machine is driven by a single drive motor.

In systems according to the invention, the portion of each spinning unit constituted by feed roller 1, breakup roller 2, turbine 3 and extraction tube 4 could have the structure disclosed in German Auslegeschrift (Published Application) No. 1,111,549 or in U.S. Pat. Application Ser. No. 422,144, filed on Dec. 6th, 1973.

The parts 1, 2, 3 and 4 are also described in more detail in the U.S. Pat. No. 3,210,923. For identification, please refer to parts 11, 12 and 1 shown in FIG. 1 and the yarn extraction tube 26 in FIG. 4 of that specification. The slitted drum 7 and the yarn spool 8 mentioned in this application are likewise shown in that U.S. Pat. No., namely as parts 28, 29, 30 and 31 in FIG. 4. The slitted drum 7, in particular, is also shown as part 13 in FIG. 1 of the U.S. Pat. No. 3,354,631.

Any further spinning units not shown in FIG. 1 are connected to the shafts 13, 23, 54, 63 and 65 in the same manner as are the spinning units shown. Accordingly, all other spinning units have the same belt drives as shown, with the pulleys 14/15, 24/25 and 55/56.

The latter three belt drives are not varied in their transmission ratios. They are given a definite transmission ratio when the machine is designed.

The air-core relay mentioned above is an auxiliary current actuated switch operating without time delay.

It will be understood that the above description of the present invention is susceptible to various modifications, changes and adaptations, and the same are intended to be comprehended within the meaning and range of equivalents of the appended claims.

We claim:

1. In a method for the automatic starting and stopping of an open-end spinning machine system containing a plurality of spinning units, the components of each unit including a spinning turbine having a fiber collection trough, a breakup roller, a feed roller, a yarn extraction device and a yarn winding apparatus, wherein, during stopping of the system, the rates of rotation of the turbine, the feed roller, the yarn extraction device and the yarn winding apparatus of each unit are simultaneously reduced to below the normal spinning speed before being completely stopped, and the end of each yarn being spun remains in its spinning turbine and during restarting of the system each yarn extraction device and winding apparatus are caused to move opposite to their direction of normal movement for a limited time to feed the yarn end back into the spinning turbine, and the spinning turbine, the feed roller, the yarn extraction device and the yarn winding apparatus are brought to a rated speed below the normal spinning speed in order to start the spinning process, the improvement wherein:

a. the stopping of the system, from an operating state, comprises the steps of:

i. effecting such simultaneous reduction in the rates of rotation of the turbine, feed roller, yarn extraction device and yarn winding apparatus of each unit by permitting the rates of rotation thereof to decrease in unison in a free run-down manner while remaining within the range permitting yarn spinning to continue, and ii. positively and rapidly braking such components only when their rates of rotation reach the lower limit of such range; and b. the restarting of the system comprises effecting such movement of the yarn extraction device and the winding apparatus of each unit opposite to their normal direction of movement by initially driving the yarn extraction device and the yarn winding apparatus of each unit through a selected, fixed, distance in the direction opposite to their normal operating direction, which distance is independent of the existing speed of the system, for feeding a fixed, predetermined, length of yarn back into the fiber collection trough of the associated spinning turbine.

2. A method as defined in claim 1 wherein the spinning turbine, the feed roller, the yarn extraction device and the yarn winding apparatus are driven by drive means connected to receive operating power from a power supply and said step of effecting simultaneous reduction in the rates of rotation is carried out by disconnecting the drive means from the power supply.

3. A method as defined in claim 2 wherein the restarting of the system further comprises separately bringing the breakup roller of each unit to its normal operating speed before accelerating the other components of the respective unit to a speed which permits yarn spinning to occur.

4. A method as defined in claim 3 wherein the stopping of the system further comprises allowing the breakup roller to run down to a stopped position only at a time after completion of said step of braking.

5. A method as defined in claim 2 wherein the restarting of the system further comprises starting rotation of the feed roller of each unit, under control of a time delay relay, while said step of initially driving the yarn extraction device and the yarn winding apparatus is occurring.

6. Method as defined in claim 5 wherein all components of every unit are driven by a single drive motor.

7. A method as defined in claim 2 wherein the stopping of the system further comprises allowing the breakup roller to run down to a stopped position only at a time after completion of said step of braking.

8. A method as defined in claim 1 wherein the restarting of the system further comprises separately bringing the breakup roller of each unit to its normal operating speed before accelerating the other components of the respective unit to a speed which permits yarn spinning to occur.

9. A method as defined in claim 8 wherein the stopping of the system further comprises allowing the breakup roller to run down to a stopped position only at a time after completion of said step of braking.

10. A method as defined in claim 1 wherein the stopping of the system further comprises allowing the breakup roller to run down to a stopped position only at a time after completion of said step of braking.

11. A method as defined in claim 1 wherein the restarting of the system further comprises starting rotation of the feed roller of each unit, under control of a time delay relay, while said step of initially driving the yarn extraction device and the yarn winding apparatus is occurring.

12. A method as defined in claim 11 wherein all components of every unit are driven by a single drive motor.

* * * * *